US005969614A

United States Patent [19]

Holmgren

[11] Patent Number: 5,969,614

[45] Date of Patent: Oct. 19, 1999

[54] ALARM TAG

[75] Inventor: Bertil Holmgren, Vellinge, Sweden

[73] Assignee: MW International, Ltd., Surrey, United Kingdom

[21] Appl. No.: 09/051,580

[22] PCT Filed: Oct. 8, 1996

[86] PCT No.: PCT/SE96/01268

§ 371 Date: Apr. 13, 1998

§ 102(e) Date: Apr. 13, 1998

[87] PCT Pub. No.: WO97/14125

PCT Pub. Date: Apr. 17, 1997

[30] Foreign Application Priority Data

Oct. 12, 1995 [SE] Sweden ..... 9503558

[51] Int. Cl.[6] ..... G08B 13/22

[52] U.S. Cl. ..... 340/572.9; 340/388.4; 340/391.1; 340/572.1; 340/693.5

[58] Field of Search ..... 340/572.1, 572.9, 340/693.5, 388.4, 391.1

[56] References Cited

U.S. PATENT DOCUMENTS 4,328,486 5/1982 Burstein et al. ..... 340/391.1
4,812,811 3/1989 Asbrink et al. ..... 340/571
5,347,262 9/1994 Thurmond et al. ..... 340/572.9

FOREIGN PATENT DOCUMENTS 2 272 987 6/1994 United Kingdom ..... G08B 13/06
WO 95/27959 10/1995 WIPO .

*Primary Examiner*—Glen Swann
*Attorney, Agent, or Firm*—Mason & Assoc., P.A.; Dennis G. LaPointe; Joseph C. Mason, Jr.

[57] ABSTRACT

An alarm tag made of two parts, one of which is provided with a pin (13) attached to the one part (12) to be located on one side of the product (11) with the pin extending through the product into locking engagement with the other part (10) located on the opposite side of the product. A resonance chamber (29), mounted in the one part (12), having a central outlet (30) is provided for activating the alarm device. A cover (19) is mounted on the one part (12) over the resonance chamber, and includes a central portion in register with the outlet (30), and bars (36) extending radially from the central portion (35) to the periphery of the cover, the bars defining slots (37) between adjacent bars.

4 Claims, 3 Drawing Sheets

ALARM TAG

FIELD OF THE INVENTION

The invention relates to an alarm tag comprising two parts one of which is provided with a pin attached to said one part to be located on one side of a product with the pin extending through the product into locking engagement with the other part located on the opposite side of the product, said one part having means for activating an alarm device in said one part.

BACKGROUND OF THE INVENTION

The alarm tag is of the type disclosed in PCT/SE95/00385 the content of which is incorporated herein by reference.

The purpose of the invention is to further improve the security against unauthorized removal of an alarm tag of the type referred to above from the product to be protected against theft by means of the alarm tag, and particularly to minimize the possibility of attenuating the sound emitted from the alarm tag when the alarm is trigged due to manipulation of the tag.

GB-A-2 272 987 describes a gas driven alarm carried at the top end of a closed tubular housing enclosing a liquid propellant container. The casing has an apertured frustoconical top portion the apertures in which are located laterally in the top portion and are protected by flanges and finer inner mesh each aperture being located between adjacent flanges. The alarm device is essentially a conical volume with a vibratory diaphragm at the narrow end and its larger mouth opening to the outside radially of the frustoconical top portion through the apertures therein.

SUMMARY OF THE INVENTION

The present invention is an alarm tag comprising two parts, one of which is provided with a pin attached to said one part to be located on one side of the product with the pin extending through the product into locking engagement with the other part located on the opposite side of the product, said one part having means for activating an alarm device in said one part, characterized in that the alarm device comprises a resonance chamber having a central outlet, and a cover mounted on said one part over said resonance chamber. The cover has a central portion in register with the outlet and bars extending radially from the central portion to the periphery of the cover. The bars define slots between adjacent bars. Other embodiments of the present invention are further described hereinafter.

BRIEF DESCRIPTION OF THE DRAWINGS

In order to explain the invention in more detail reference is made to the accompanying drawings which disclose an illustrative embodiment and wherein.

DETAILED DESCRIPTION OF THE INVENTION

Figure 1:
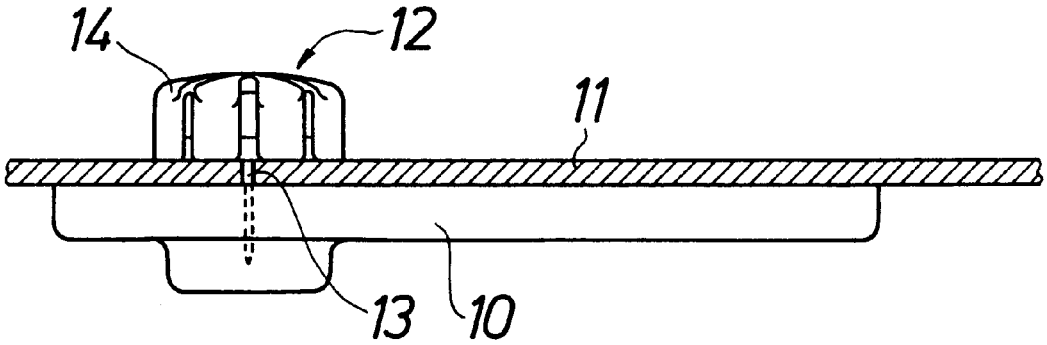
FIG. 1 is a side view of an alarm tag attached to a product which is shown fragmentarily in cross section.
Figure 2:
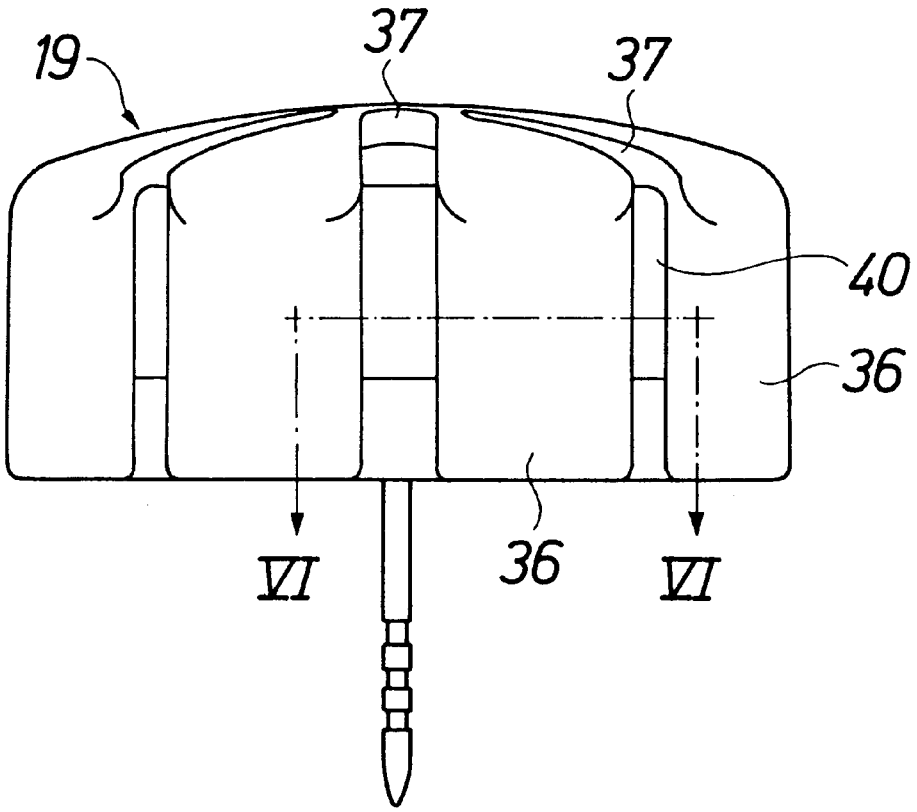
FIG. 2 is an enlarged side view of that part of the alarm tag which comprises a pin and a head.
Figure 3:
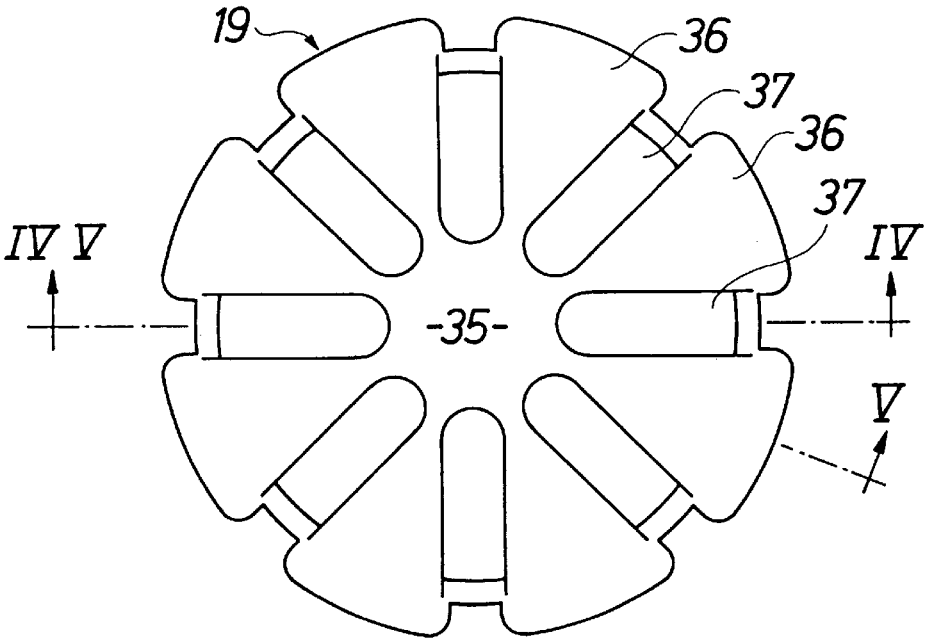
FIG. 3 is a plan view of the pin part of FIG. 2.

In FIG. 1 there is disclosed an alarm tag which comprises a first part 10 containing means for initiating alarm from an alarm device which either is built into this part or consists of an external alarm device. The alarm is initiated when the alarm tag is carried out from a defined area in a department store or a shop due to the fact that the alarm tag then, at the exit from said area, will leave an electromagnetic or electrostatic field maintained in said area, or is carried through such a field maintained between bows located one at each side of the exit passage. This part of the alarm tag can be of any existing known construction. Part 10 is applied to one side of a product 11. The alarm tag also comprises a second part 12 consisting of a pin 13 with a head 14 said head being applied to the opposite side of product 11 with the pin extending through the product and being attached to part 10. The attachment is such that the parts cannot be moved apart for removal of the alarm tag from the product unless the attachment is operated magnetically or mechanically in a special device at the site where the product is to be paid, according to a well-known technique applied in connection with alarm tags.

Figure 4:
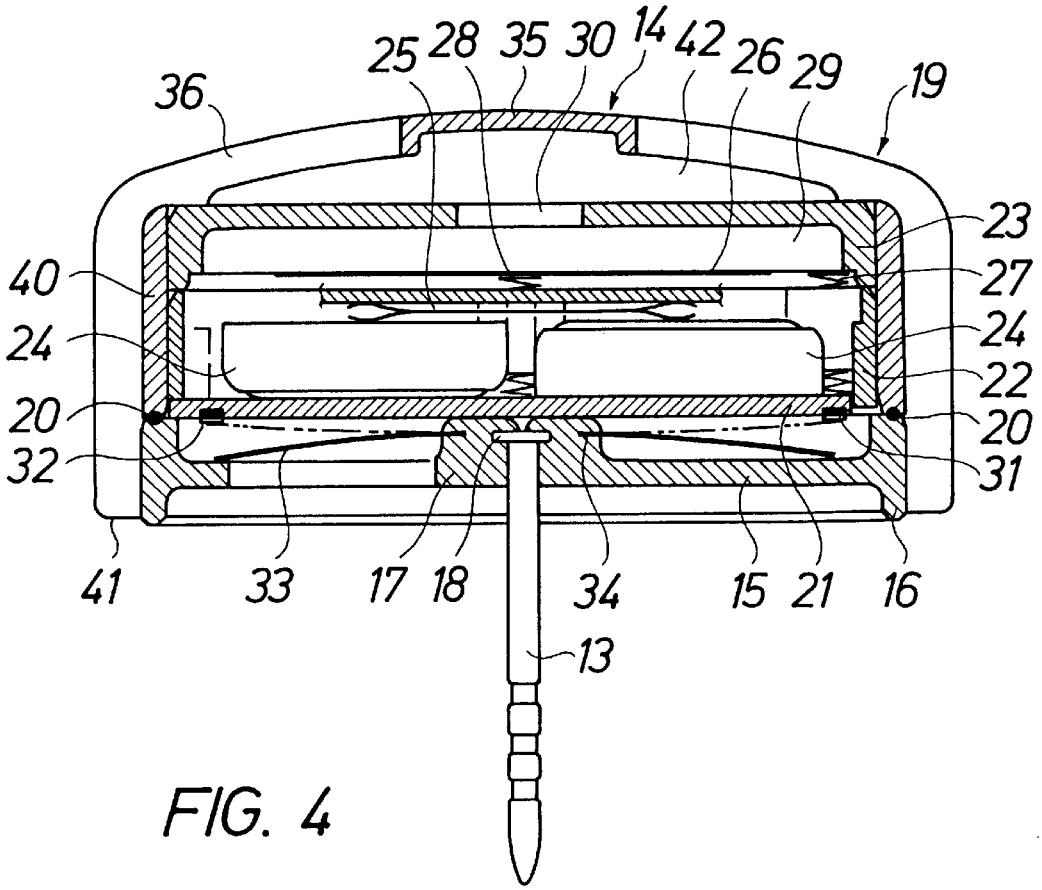
FIG. 4 is a cross sectional view of the pin part of FIGS. 2 and 3 taken along line IV—IV in FIG. 3.
Figure 5:
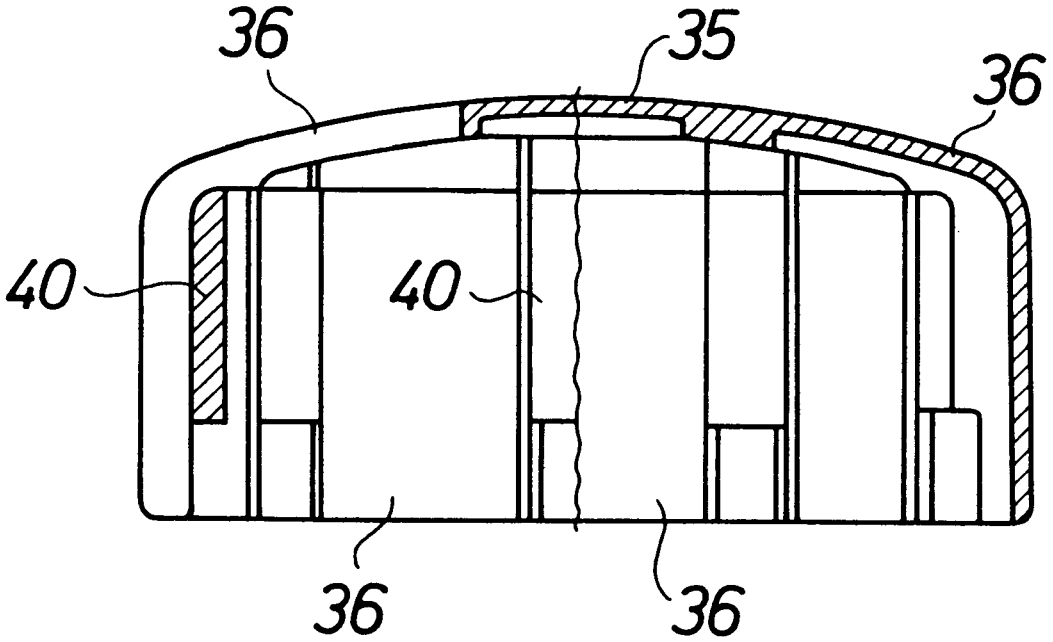
FIG. 5 is a cross sectional view of a cover mounted on the pin part of FIGS. 2 and 3, taken along line V—V in FIG. 3.

Part 12 is shown in detail in FIG. 4 and as can be seen head 14 comprises a bottom plate 15 which has for example circular shape. Said plate preferably is made of plastics of such kind that the plate is impact resistant and elastically deformable and also can be fused. A suitable material is for example polycarbonate. The plate has a downwardly extending peripheral rim 16 which stiffens the plate at the periphery, and a central bulge 17 in which the pin is attached at a head 18 formed on the pin. A cylindrical cover 19 which will be described below in more detail is fused to plate 15 at 20. A circuit board 21 carrying an electronic alarm circuit is located on top of plate 15. An annular battery holder 22 and an inverted tray 23 on top of the battery holder are clamped between circuit board 21 and cover 19, so that details 21, 22 and 23 are firmly mounted between plate 15 and cover 19 inside the cover. Two alkaline batteries 24 of the button type are mounted by means of battery holder 22 on circuit board 21 in electric contact with the electronic alarm circuit on said board and are interconnected in series by means of a contact blade spring 25 which is kept in contact with the batteries by means of the battery holder. A membrane 26 comprising a piezo-electric ceramic element is attached to the inverted tray 23 at the rim thereof and is connected with the electronic alarm circuit on the circuit board 21 by means of helical contact springs 27 and 28. Membrane 26 defines together with tray 23 a resonance chamber 29 which communicates with the interior of cover 19 through a central aperture 30 in tray 23. Normally, the electronic alarm circuit is not energized. In order to energize the electronic alarm circuit contacts 31 and 32 on the lower side of the circuit board 21 must be interconnected.

A contact element for interconnecting contacts 31 and 32 comprises a bistable spring washer 33 of metal located in a space defined between circuit board 21 and plate 15, and is attached at a central opening therein to bulge 17 by the edge portion around the opening being received in a circular circumferential groove 34 in bulge 17. The spring washer normally is in one stable position shown by solid lines, in which the spring washer is arched downwards and engages at the periphery thereof the upper surface of plate 15. When the spring washer is in this position the electronic circuit is de-energized and the alarm device accordingly is passive. At any attempt to move the two parts of the alarm tag apart or to cut off the pin by means of a cutter or the like which is inserted between the parts pin 13 will be exposed to axial tension or be tilted, which causes deformation of plate 15. Due to such deformation of plate 15 the spring washer will snap to the other stable position thereof which is shown by dot and dash lines in FIG. 4. In this position the spring washer is arched upwards in order to engage at the periphery thereof contacts 31 and 32 at the lower side of the circuit board 21 so that the electronic alarm circuit will be energized. Then, membrane 26 will be induced to oscillate at a predetermined frequency which is also the resonance frequency of resonance chamber 29, and sound will be emitted through aperture 30. Preferably the sound is emitted intermittently at a predetermined repetition rate as a train of short sound pulses. In order that the generated sound will be "let out" to the surroundings through cover 19 this cover is of a specific design in order to eliminate any possibility of non-scrupulous individuals manipulating the device in order to suppress the sound so that it may not be heard by people in the surroundings.

Figure 6:
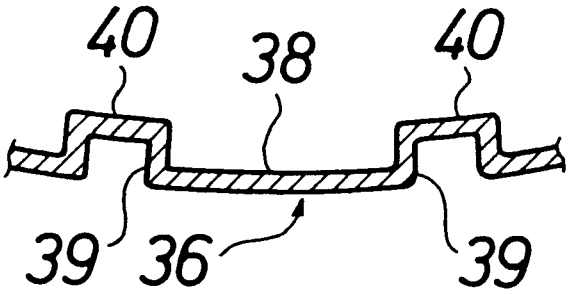
FIG. 6 is a cross sectional view taken along line VI—VI in FIG. 2.

Cover 19 is constructed as a cage having a central portion 35 which is in register with aperture 30 in tray 23. The top wall of the cover is slightly arched and comprises uniformly distributed bars 36 which project from central portion 35 to the periphery of the cover the width of said bars increasing from portion 35 towards the periphery of the cover so that adjacent bars define a radial slot 37 of uniform width. At the periphery of the cover the bars extend axially downwards. The axial portion of each bar has uniform width. Bars 36 are channelled at the back side thereof not only in the axial portion as will be seen in FIG. 6, but also in the top wall portion, and have a web 38 and side flanges 39. The spacing between adjacent axial portions of bars 36 is covered by a web 40 the lower end of which is spaced from the lower edge of cover 19 formed by bars 36, rim 16 of wall 15 being received inside the cover below webs 40 to be fused to said webs at 20. The lower ends of the axial portions of bars 36 terminate a small distance from the lower edge of rim 16 at 41.

A space 42 is defined between tray 23 and cover 19 at the top wall thereof said space communicating with resonance chamber 29 through aperture 30. Normally the sound produced by membrane 26 in resonance chamber 29 when the electronic alarm circuit is energized will be transmitted to space 42 and from there to the surroundings through slots 37. Now, if these slots are covered by the hand or by means of a plastic mass such as chewing gum in an effort to suppress the sound in case the alarm tag is being manipulated the sound will still pass through the channels formed by bars 36 so that the sound will be transmitted to the surroundings at 41 where said channels open spaced from product 11. These openings cannot easily be covered.

In the premises where the alarm tag is being used there can be provided a receiver which is tuned to the frequency and repetition rate of the sound transmitted by the alarm tag when energized even if such sound is attenuated by manipulation of the alarm tag, and which is trigged by the sound in order to energize one or more alarm devices provided in the premises, so that this alarm device or these alarm devices emit a strong alarm sound in the premises if the alarm tag is being manipulated.

If the alarm device has been activated it can be shut off by the spring washer being brought to snap back to the position shown by solid lines, but such resetting should of course be possible only in a device provided especially for that purpose by actuation of the spring washer.

I claim:

1. Alarm tag comprising two parts one of which is provided with a pin (13) attached to said one part (12) to be located on one side of a product (11) with the pin extending through the product into locking engagement with the other part (10) located on the opposite side of the product, said one part having means for activating an alarm device in said one part, characterized in that the alarm device comprises a resonance chamber (29) having a central outlet (30), and a cover (19) mounted on said one part (12) over said resonance chamber, said cover having a central portion in register with said outlet (30), and bars (36) extending radially from said central portion (35) to the periphery of the cover, said bars defining slots (37) between adjacent bars.

2. Alarm tag as in claim 1, characterized in that said bars (36) extend along a side wall of the cover.

3. Alarm tag as in claim 1 or 2, characterized in that said bars (36) are channelled at the back side thereof.

4. Alarm tag as in claim 3, characterized in that the channels formed by said bars (36) open at the lower end thereof spaced from the lower side of said one part (12).

* * * * *